United States Patent [19]

Ciarcia et al.

[11] Patent Number: 4,698,903

[45] Date of Patent: Oct. 13, 1987

[54] CIRCUIT BREAKER HIGHSPEED ASSEMBLY

[75] Inventors: Ronald D. Ciarcia, Southington; Gregory T. DiVincenzo, Plainville; Dennis J. Doughty, Plainville; Richard E. Bernier, Plainville, all of Conn.

[73] Assignee: General Electric Company, New York, N.Y.

[21] Appl. No.: 869,768

[22] Filed: Jun. 2, 1986

Related U.S. Application Data

[60] Division of Ser. No. 718,409, Apr. 1, 1985, Pat. No. 4,622,530, which is a continuation-in-part of Ser. No. 500,643, Jun. 2, 1983, abandoned.

[51] Int. Cl.[4] ..... H01H 65/00

[52] U.S. Cl. ..... 29/622

[58] Field of Search ..... 29/622; 335/202, 132, 335/167

[56] References Cited

U.S. PATENT DOCUMENTS

| | | | |
|---|---|---|---|
| 2,048,114 | 7/1936 | Gano et al. | 335/22 |
| 3,046,371 | 7/1962 | Jencks | 335/21 |
| 3,222,475 | 12/1965 | Woods et al. | 335/35 |
| 3,603,755 | 9/1971 | Ranzanigo | 335/132 |
| 4,246,557 | 1/1981 | Michetti et al. | 335/13 |

*Primary Examiner*—P. W. Echols

*Attorney, Agent, or Firm*—Richard A. Menelly; Walter C. Bernkopf; Fred Jacob

[57] ABSTRACT

A circuit breaker design and process for high speed assembly utilizes a unique secondary latch arrangement to reduce frictional forces and increase the breaker calibration test yield. The design allows for interchangability of the trip unit by first pre-assembling the arc chute cavity and operating mechanism. Arrangement of the primary and secondary latch pivots reduces the trip force for further increase in the calibration yield.

9 Claims, 5 Drawing Figures

CIRCUIT BREAKER HIGHSPEED ASSEMBLY

This is a division of application Ser. No. 718,409 filed Apr. 1, 1985, now U.S. Pat. No. 4,622,530 which is a continuation-in-part of co-pending Ser. No. 500,643 filed June 2, 1983, now abandoned.

BACKGROUND OF THE INVENTION

Electric circuit breakers for low voltage and high current applications have not heretofore been fabricated on high speed efficient assembly lines. The large number of breaker ratings for each frame size generally require a correspondingly large number of different breaker designs for each rating. Because of the variety of different parts required for each of the breaker ratings, it is difficult for a single assembly line to efficiently assemble more than a few breaker designs without substantial changeover in parts, tools and test procedures. A further drawback to efficient high speed breaker assembly is the stringent requirement that each breaker be individually tested for calibration. This is accomplished by applying a test current above the steady state rated current and determining whether the breaker trips within a predetermined time interval. If the breaker successfully trips within the time interval, the breaker is then forwarded along the assembly line to the next step in the assembly process. If the breaker fails to trip within the proper time, an adjustment is made to correct breaker tripping before the breaker can proceed along the assembly process. The number of breakers successfully passing the trip test, i.e. tripping within the required time interval, in relation to the total number of breakers tested, is defined as the "yield". For a 150 amp industrial type E-Frame breaker assembly line for example, a typical yield value should be in excess of seventy percent.

Another factor that effects the speed and efficiency of the existing breaker assembly process is the engagement of the operating springs within the operating mechanism assembly. The spring is engaged in an uncharged or un-stressed condition on the operating spring support pin and is then connected with the operating handle yoke by the use of a special tool. The operator first engages the hook of the operating spring by inserting the tool through an opening in the top of the handle yoke and further elongating the spring to move the hook back through the opening to engage a web on the handle yoke crosspiece. Since there are two operating springs involved, some valuable assembly time is involved even by skilled operators.

A further obstacle to an efficient high speed breaker assembly process is the difficulty encountered in assembling the contact spring sub-assembly to the contact arm carrier against the bias of the contact spring.

A time consuming polishing process is required on the latch system's secondary latch surfaces. The polishing is required to minimize the amount of tripping force that must be applied to overcome the bias of the operating spring and the static friction of the contacting latch surfaces. Although the polishing can be done in a separate pre-assembly process without affecting the actual circuit breaker assembly operation, it has been determined that the variation in the "trip force", that is the amount of force that must be applied to the trip bar to overcome the latch spring bias and latch surface friction, depends to a certain extent upon the polishing operation. A typical value of the coefficient of fricition for an unpolished secondary latch surface is 0.5 where the value for a highly polished secondary latch surface can be as low as 0.1. The primary and secondary latch surfaces are fabricated from stamped metal parts which exhibit a burr on the edge of one surface and a die roll on the edge of the opposite surface. With secondary latch mating surfaces, the burr edge surface can result in variable frictional forces even after polishing.

One example of an industrial type E-frame circuit breaker employing primary and secondary latches is given within U.S. Pat. No. 3,605,052 in the names of Herbert M. Dimond et al. This breaker employs a pivotally mounted rectangular latch plate having a rectangular aperture cut through the plate to support the end of the cradle under a forward edge of the latch plate aperture when the breaker is in a "latched" condition. This forward edge comprises the primary latch surface for this breaker design and is "shaved" to insure a flat surface. Both the cradle and the latch are fabricated from a stamping operation followed by a shaving operation to flatten and smooth the surface of the cradle and the latch aperture to maintain a low trip force between the cradle and primary latch surfaces. For a good description of the shaving operation see pages 116–118 in the publication entitled "Advanced Diemaking", McGraw Hill Book Company 1967 Edition, New York, N.Y. The secondary latch surface for the aforementioned E-frame breaker comprises the rear surface of the latch plate which retains a rolled pin connected to the trip bar. Since the primary latching forces provided by the operating spring are much greater than the secondary latching forces provided by the lighter secondary latch spring, the effect of friction is substantially critical with respect to release between the secondary latch surface and the trip bar rolled pin. The rolled pin is formed from a high carbon steel and is rounded over to provide a smooth contact surface with the secondary latch surface and the latch plate is oriented to provide the smooth stamped surface with the smooth die rolled edges facing the trip bar rolled pin.

An early attempt to reduce friction between latching surfaces is described within U.S. Pat. No. 4,119,935 entitled "Circuit Interrupter Including Low Friction Latch". This patent describes latching surfaces having a rough and smooth portion resulting from the metal stamping operation and disposes the latching surface so that only the smooth portions of the latching surfaces are in contact.

The purpose of this invention is to provide a circuit breaker design and a method of assembly which substantially overcomes the aforementioned obstacles to result in an efficient high speed circuit breaker assembly process.

SUMMARY OF THE INVENTION

A circuit breaker design and an assembly process wherein the contact spring sub-assembly is pre-assembled with the spring in an unstressed condition, and wherein the operating springs are assembled outboard of the handle yoke in full view of the operator and not through a blind hole. Interchangeability of the trip unit within the breaker housing allows for maximum flexibility in the selection of specific trip units for different current ratings within a standard breaker design after the main portion of the breaker assembly, which includes the arc chute cavity and operating mechanism, is assembled. Further, the secondary latch design and the geometric arrangement of the primary and secondary latch pivots substantially reduces the breaker trip force to increase the test yield on calibration.

DESCRIPTION OF THE PREFERRED EMBODIMENT

Figure 1:
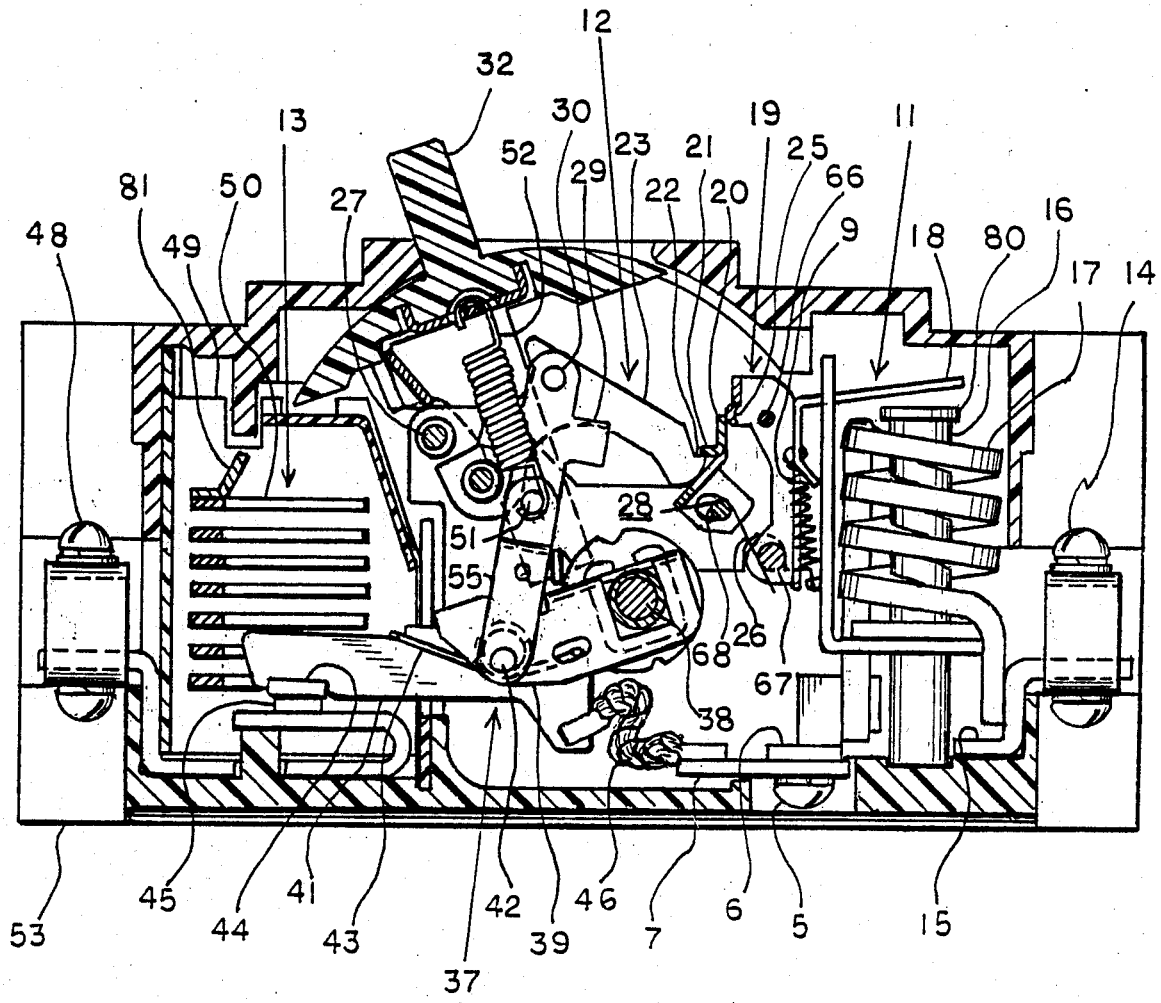
FIG. 1 is a side view of the circuit breaker assembly according to the invention.
Figure 2:
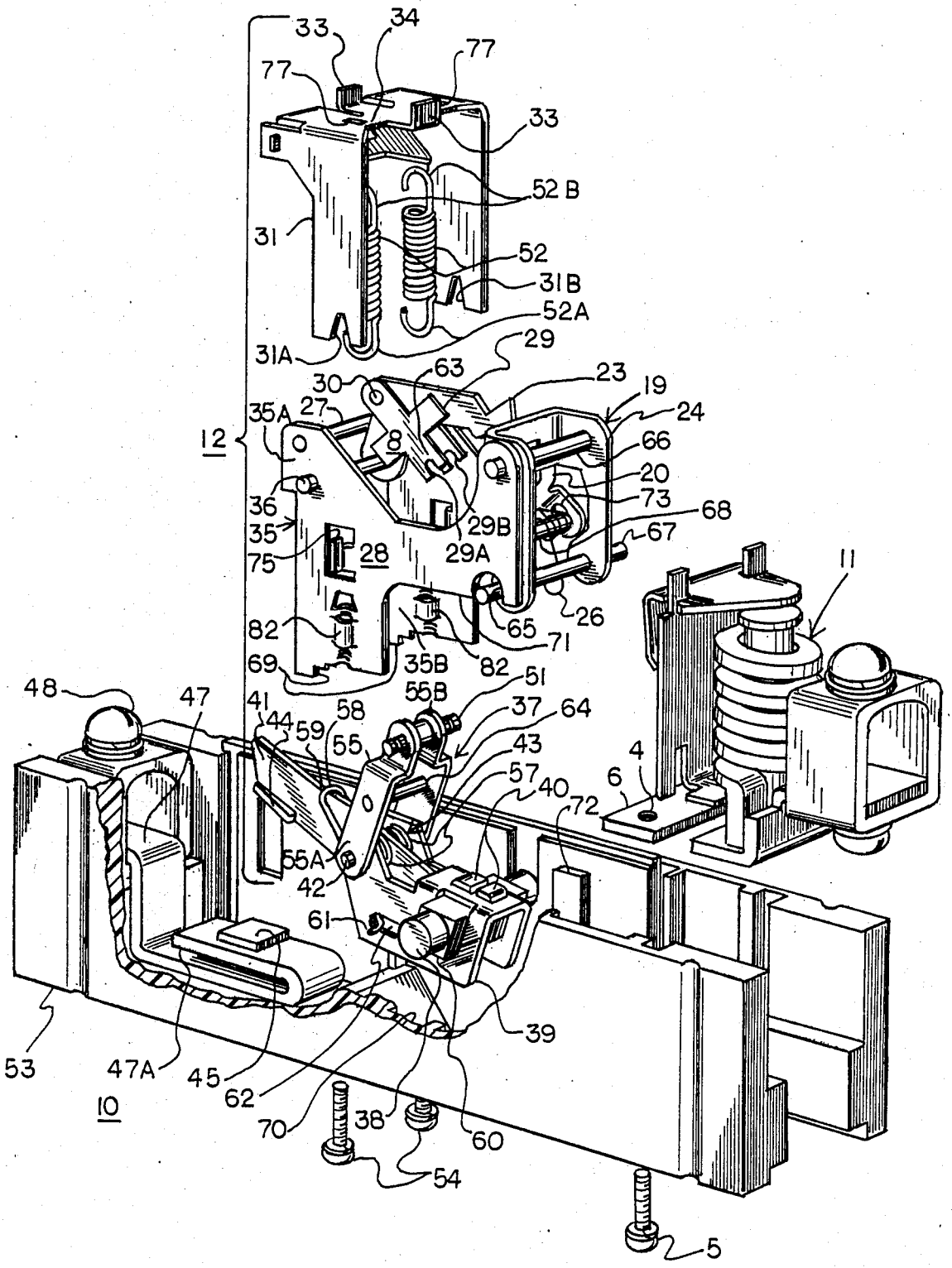
FIG. 2 is a front perspective view in isometric projection of the contact arm sub-assembly within the breaker depicted in FIG. 1.

A circuit breaker assembly 10 is shown in FIGS. 1 and 2 and consists of a trip assembly unit 11, an operating mechanism 12 and an arc chute 13. The trip unit assembly includes a load terminal post 14 connecting through a load terminal strap 15 to a dashpot 16 surrounded by a coil 17, and a coil tab 6 electrically connected in series with the load terminal strap 15. A pivotally mounted armature 18 biased away from the dashpot by armature spring 9 responds to the electromagnetically induced field within coil 17 in response to overload conditions to trip the breaker. The latch system 19 consists of a primary latch 20 having a primary latch extension 21 for retaining a step 22 on the circuit breaker cradle 23, and a secondary latch 24 with a secondary latch extension 25 which contacts the primary latch 20 preventing it from rotating clockwise and releasing the cradle 23. When the armature 18 is magnetically attracted to the dashpot cap 80 by the magnetic field created by coil 17, the secondary latch 24 is rotated clockwise via trip bar 67 bringing the secondary latch extension 25 out of engagement with the primary latch 20 allowing the primary latch extension 21 to release the cradle step 22 and allowing cradle 23 to collapse the operating mechanism 12 thereby allowing breaker contact arm 41 to move to its open position. Side frame 35, which includes frame sides 35A, 35B, assists in supporting the cradle stop pin 27, the primary latch pivot pin 68, latch spring 26, as well as the secondary latch pivot pin 66. The cradle sub-assembly 8, best seen in FIG. 2, includes cradle pivot pin 36 which carries the cradle 23 which in turn pivotally supports the upper links 29 by means of pivot pin 30. The latch system 19, cradle sub-assembly 8 and sidewall 35 comprise the entire mechanism sub-assembly 28.

A stop 65 formed on sideframe 35 assists in positioning the secondary latch 24 relative to the primary latch 20 to provide for the correct pre-tripped latch engagement between the primary and secondary latches. A handle yoke 31 supports an ON-OFF handle 32 by means of a pair of upstanding tabs 33 along the surface of crosspiece 34.

The contact arm sub-assembly 37 consists of the crossbar 38 which supports the contact arm carrier 39 by means of a staple 40. The movable contact arm 41 is connected to the contact arm carrier 39 and lower links 55 by means of lower link pivot pin 42. The contact spring 43, connecting the movable contact arm 41 at one end and the contact arm carrier 39 at an opposite end, provides proper contact pressure between the movable and stationary contacts 44 and 45 in the closed position. The circuit is completed from line terminal post 48 and line terminal strap 47 through fixed and movable contacts 45, 44 and movable contact arm 41 through a flexible braid 46 and tab 7, to the coil tab 6 of coil 17 out to load terminal post 14 through load terminal strap 15. The arc chute 13 consists of an insulated housing 49 supporting a plurality of arc plates 50 with the topmost arc plate having an attached arc horn 81. The mechanism sub-assembly 28 is connected to the contact arm subassembly 37 as best seen in FIG. 2 by fitting the ends 63 of the upper links 29 over the operating spring support pin 51. The operating springs 52 connect between the handle support yoke 31 and the operating spring support pin 51 to complete the entire operating mechanism 12. In an E-Frame molded case circuit breaker design such as described within the aforementioned U.S. Pat. No. 3,605,052 to Herbert M. Dimond et al., which patent is incorporated herein for purposes of reference, the current rating can range from 10 to 100 amperes at 600 volts. The provision of the operating mechanism 12 on the common side frame 35 allows both the trip unit 11 and the arc chute 13 to be selected and mounted after the assembly of the common operating mechanism 12 providing maximum flexibility and is an important feature of the instant invention.

To facilitate speed of assembling the breaker components, the contact arm sub-assembly 37 is pre-assembled and positioned within the breaker casing 53. The crossbar 38 is inserted within the contact arm carrier slot 60 and secured by means of staple 40. The mechanism sub-assembly 28 is positioned on the contact arm subassembly 37 and then fastened to the breaker casing 53 by means of screws 54. The movable contact arm 41 is fitted with the contact spring 43 by arranging the spring loops 57 on either side of the contact arm and fitting the spring crossover arm 58 against the raised extension 59 on the contact arm proximate the movable contact 44. The lower link assembly 55 consisting of links 55A and 55B joined by operating spring support pin 51 and spacer pin 64 is first positioned over both the movable contact arm 41 and contact spring 43 and then over the contact arm carrier 39 before being connected by means of lower link pivot pin 42.

The contact spring angled ends 61 are then inserted outwardly through slots 62 on both sides of the contact arm carrier 39 to bias the contact arm in a counter clockwise direction.

The mechanism sub-assembly 28 is pre-assembled in the following manner. The upper link 29 and cradle 23 are pivotally connected by means of upper link pivot 30 before connecting the cradle between the two sides 35A, 35B of side frame 35 by means of cradle pivot pin 36. The cradle stop pin 27 is then connected in a similar manner. The latch system 19 is pivotally connected between the sides 35A, 35B by means of a secondary latch pivot pin 66 and the latch spring 26 is arranged around a latch spring support pin 68 which also provides the pivot for the primary latch 20 with one end biasing the trip bar 67 and secondary latch 24 against frame stop 65 and the other end biasing the primary latch 20 against the secondary latch surface 25. This is shown in better detail in FIG. 3. The mechanism subassembly 28 is then inserted within breaker casing 53 and is supported within the casing by inserting foot members 69, formed on the bottom of side frame 35, within a pair of molded recesses 70 formed in the bottom of the casing and by arranging the side wall bottom surfaces 71 on corresponding mounting pads 72 also formed in the bottom of the casing. The slotted yokes 29A, 29B on bottom ends 63 of upper link 29 are fitted over the protruding ends of operating spring support pin 51 extending from both legs 55A and 55B of lower link 55. The mechanism sub-assembly 28 is then secured to the casing by screws 54 driven into the bifurcated threaded areas 82 at the bottom of side frame 35 also capturing the contact arm assembly 37. The handle yoke 31 is now assembled over the mechanism sub-assembly 28 by arranging the pair of slotted yokes 31A, 31B formed on the bottom of handle yoke 31, over a corresponding pair of tabs 75 extending outwardly from both walls 35A, 35B of side wall 35. The bottom hooked ends 52A of operating springs 52 are looped around the recess of the protruding ends of operating spring support pin 51 on lower links 55. The top hooked ends 52B of operating springs 52 are then extended over yoke crosspiece 34 and inserted within a pair of corresponding positioning slots 77 formed within the yoke crosspiece 34 to complete the assembly of the operating mechanism 12. The on-off handle 32 is then attached to the completed operating mechanism by means of the pair of upstanding tabs 33 on crosspiece 34 as shown in FIG. 1.

The completed operating mechanism 12 can now be used for a wide range of breaker ampere ratings since the facility for manually opening and closing the contacts 44, 45 as well as for tripping the breaker by means of trip bar 67 are all included within the breaker assembly 10 which comprises the completed operating mechanism 12 attached within the breaker casing 53. The trip unit 11 can now be assembled to the casing 53 and connected to the contact arm assembly 37 by driving screw 5 into a threaded portion 4 of coil tab 6 capturing braid tab 7 and completing the electrical current connection as best seen in FIG. 1. Any suitable trip unit 11 can be tailored in accordance with the breaker ampere rating by changing the wire diameter and the number of turns of coil 17, should a dashpot 16 be employed as a sensor or by selecting the proper rated bimetal and magnet assembly if so desired. The arc chute 13 can also be tailored in accordance with the interruption rating by increasing the size, configuration and/or number of arc plates 50 as is well known in the art.

To facilitate rapid opening of the movable contact arm 41 and for rapidly motivating the arc that occurs between contacts 44, 45 when separated under heavy overload conditions, the line terminal strap 47 is provided with a U-shaped bend 47A as best seen in FIG. 2. The current through the breaker traverses the reverse loop to substantially increase the electromagnetic field in the plane of the fixed contact 45 to rapidly force open the movable contact arm 41 against the force provided by contact spring 43 and to rapidly motivate the arc (not shown) up to within the arc chute 13. The spring force provided by contact spring 43 is selected to minimize the electrical resistance between contacts 44, 45 during normal operating conditions but to allow the movable contact arm 41 to pivot independently of the crossbar 38 for a sufficient distance to reduce the let-through current on overload before the trip unit 11 operates to trip the breaker.

Once the breaker is completely assembled it is tested for calibration, in the manner described earlier, and is now found to have a yield ranging between 90 to 95%. One of the reasons for the high yield with the breaker design of this invention is the substantial decrease in the trip force variation caused by the absence of surface roughness conditions on the secondary latch surfaces. The mating surfaces of the secondary latch 24 depicted in FIGS. 1 and 2 are found to have a coefficient of friction of less than 0.2 without polishing. Since these components are formed from a metal stamping process which utilizes a cutting die, which effectively provides a stamped planar surface having smooth die rolled edges, an opposite planar surface having rough sharp edges, and a perpendicular die break surface having both smooth and rough portions it was determined that the polishing process could be eliminated by abutting the planar surfaces having the smooth die rolled edges.

Figure 3:
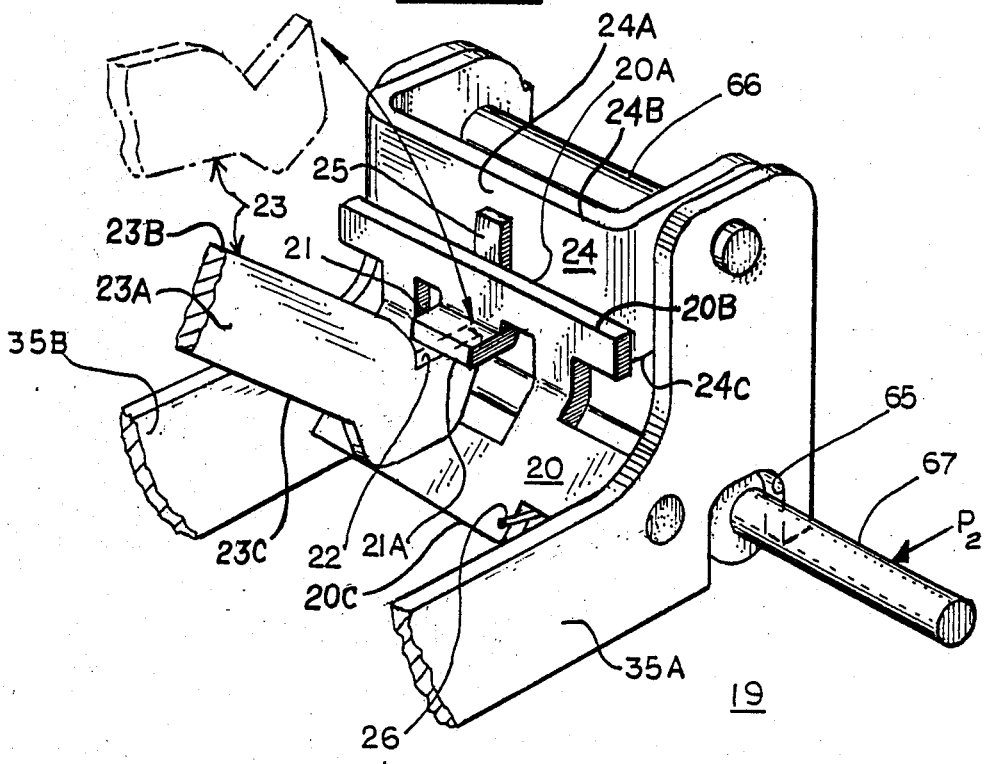
FIG. 3 is a front perspective view of the latch system within the breaker depicted in FIG. 1.

FIG. 3 details the latch system 19 in an enlarged view with the cradle 23 retained within the primary latch 20 by means of the engagement of the cradle step 22 with the primary latch extension 21. The secondary latch 24 retains the primary latch by means of engagement between the secondary latch extension 25 and the top of the primary latch 20. It was discovered that when the secondary latching surfaces such as latch extension 25 on the front surface of secondary latch 24 and the back surface 20A of primary latch 20, comprise planar surfaces having smooth die rolled edges, variation in friction due to an inconsistent polishing operation is avoided. The low and consistent friction coefficient resulting from the latching surfaces having such smooth die rolled edges substantially reduces the variation in trip force and increases the trip time repeatability of the breaker. Since the primary latch surface 21A of the primary latch extension 21 is formed from the same surface 20A of primary latch 20 no further orientation is required. The arrangement of the latching surfaces between primary latch 20 and secondary latch 24 is an important feature of this invention. It is noted that the cradle 23 engages the primary latch surface 21A by means of step 22 which represents a cut edge and which is shaved as described earlier. Also as described earlier, the stamped metal surface is defined by a perimeter of smooth die rolled edges formed perpendicular to the stamped surface and constitutes a part of the thickness of the metal stamping. The stamped surface of the cradle 23, for example, is defined by the surface 23A while the top and bottom die rolled edges closest to the stamped surface are defined as 23B and 23C. The stamped surface of the primary latch 20 is defined as the back surface 20A while the top and bottom die rolled edges are defined as 20B and 20C closest to the stamped surface. The stamped surface of the secondary latch is defined by 24A while the top and bottom die rolled edges are defined by 24B and 24C closest to the stamped surface. The secondary latch extension 25 is "coined" or formed from the stamped surface 24A of the secondary latch.

The latching surfaces 20A and 24A therefore comprise stamped surfaces and hence provide the desired low friction and minimum trip forces. The use of the stamped planar surface for the secondary latch surface distinguishes over the teachings of the aforementioned patent wherein the perpendicular die break surface is angled to reduce friction and the stamped planar surface is not employed as a latching surface.

Due to the shock that occurs when the breaker contact arms come fully open against their stops, the lightly loaded primary latch 20 can reset itself in front of secondary latch extension 25. The cradle 23 remains disengaged from the primary latch 20, after tripping, and the breaker must be reset by moving the cradle into engagement with the primary latch in order to bias the operating springs 52 and close the circuit breaker contacts 44, 45 as depicted in FIG. 1. When an attempt is made to reset the breaker, however, the engagement between the primary and secondary latches 20, 24 prevents the cradle 23, depicted in phantom in FIG. 3, from returning to a reset position. The cradle 23 is unable to get past the primary latch and the breaker is incapable of being reset and closed. The slots 73 in the sides of primary latch 20 allow the primary latch 20 to translate toward the trip bar 67 against the bias of latch spring 26 allowing the primary latch 20 to move out of the path of the downwardly moving cradle 23. Once the cradle clears the primary latch, the primary latch returns to its reset position. This is accomplished by the bias of latch spring 26 against the primary latch which forces the latch 20 back to its reset position toward the back of slots 73.

The explanation of the improved tripping response with the latch system 19 of the invention can be seen as follows. By eliminating the variation in frictional forces through the use of die rolled secondary latch surface, the tripping forces are made to depend upon the more controllable spring forces. The "trip force" is defined as the amount of force applied to the trip bar of the secondary latch sufficient to cause the breaker to trip. The "latch force" is defined as the amount of force applied to the primary latch by the operating springs via the cradle. The latch force therefore depends upon the operating spring whereas the trip force is the result of two opposing forces, namely, frictional force, as a result of the translation of the forces from the operating springs through the latch system, plus the latch spring force required to overcome these frictional forces and to bias the secondary latch in interference relation with the primary latch. This is required in order to prevent "false" tripping of the breaker by external means such as shock and vibration. Since a large operating force is required to operate the mechanism, correspondingly large trip forces are also generally required to maintain the breaker in a stable condition. With state of the art primary and secondary latch trip unit designs, 5–7 ounces of trip force is common.

Figure 4:
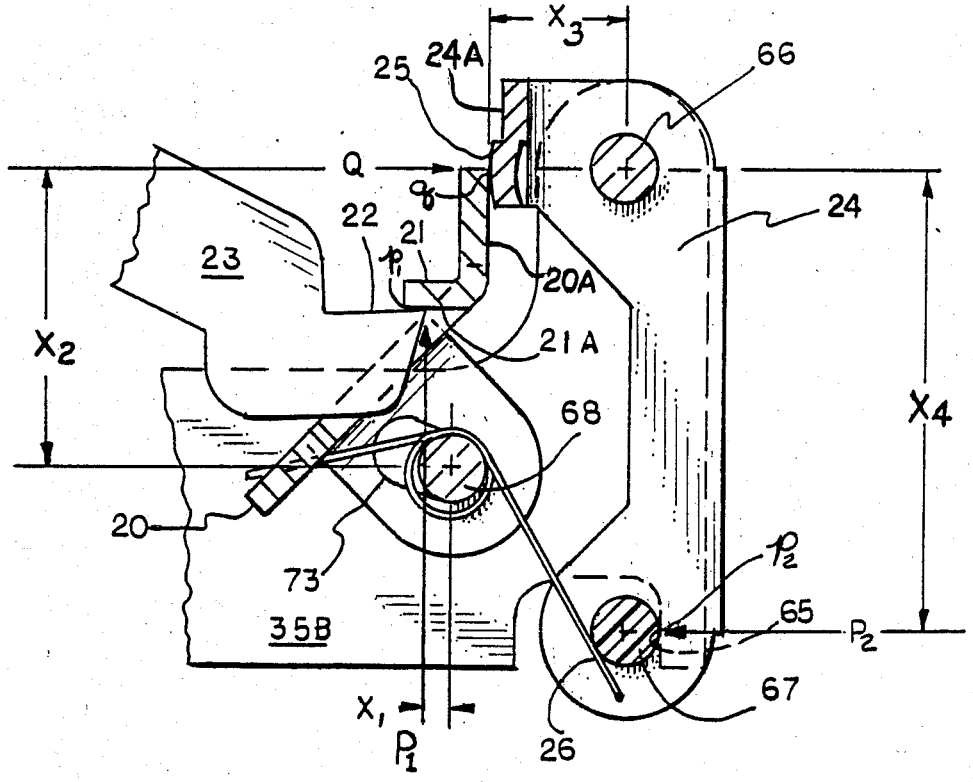
FIG. 4 is a side view of the latch system depicted in FIG. 3.

The trip unit 11 is designed to output a sufficient force necessary to overcome the trip forces and open thebreaker under overload conditions. However, if the trip forces are high and variable, size constraints may dictate an inefficient and undersized trip unit design which could result in poor yields at calibration. In order to increase the efficiency of the trip unit a lower, more stable trip force is desired. An arrangement for reducing the trip force and increasing the efficiency of the trip unit is shown in FIG. 4 and described as follows.

The latch force for keeping cradle 23 in contact with primary latch 20 is concentrated at point of contact $p_1$ between cradle step 22 and latch extension 21. The translation of the latch forces holding the primary latch 20 in engagement with the secondary latch 24 is concentrated at point q between the top of the primary latch 20 and extension 25 on secondary latch 24. As described earlier, the primary latch rotates about the primary latch pivot 68 in a clockwise direction to release the cradle 23 and trip the breaker. The torque applied at contact point $p_1$ is a product of the operating spring force $P_1$ applied at point $p_1$ times the separation $X_1$ measured as the separation distance between a center line through point $p_1$ and a center line through the primary latch pivot 68.

The torque on point q is the product of the ratio of the separation distances $X_1$ and $X_2$ times the primary cradle force applied at point $p_1$. $X_2$ is the separation distance between point q and the center line of primary latch pivot 68. By locating the interaction of the cradle 23, primary latch 20 and secondary latch 24 in such a manner with respect to the primary pivot 68,that the separation distance $X_2$ is large relative to separation distance $X_1$, a desirable force reducing ratio of 6:1 is obtained. This ratio of 6:1 reduces the cradle latch force from 8 pounds applied at point $p_1$ to 1.3 pounds at point q. This reduced force at point q correspondingly reduces the friction force between the surfaces of the primary latch 20 at 20A and the secondary latch 24 at 25 to such a low value that any variations in friction between the latch surfaces do not effect the trip force. The low friction force also allows a lighter latch spring to be used to hold the latch surfaces in a pre-tripped condition, which further reduces the trip force required to separate the latches.

Figure 5:
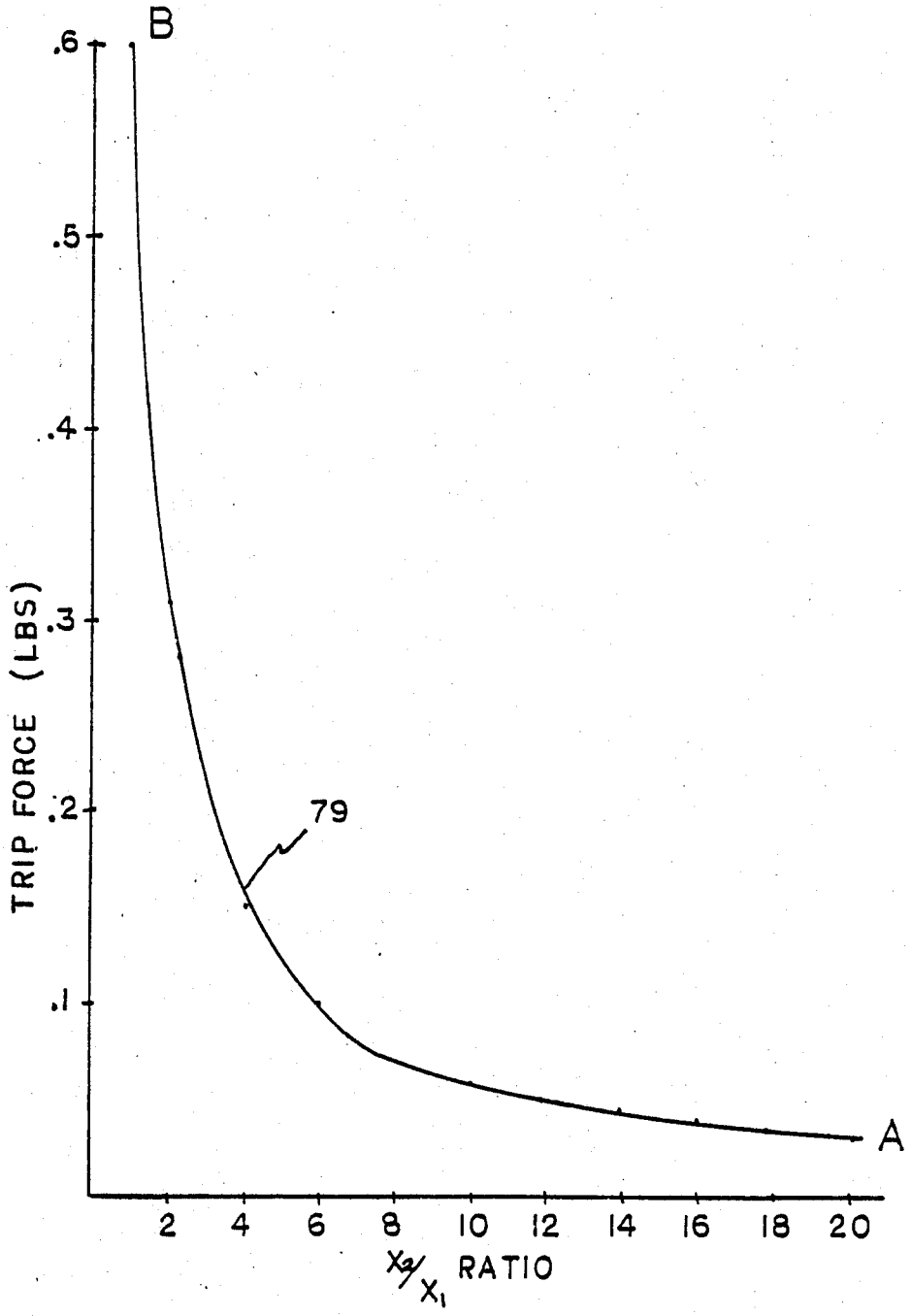
FIG. 5 is a graphic representation of the trip force as a function of latch separation distance ratios.

$X_4$ is the separation distance between the center line of the secondary latch pivot pin 66 and contact point $p_2$ on trip bar 67. $X_3$ is the separation distance between the center line of secondary latch pivot 66 and the point of contact q between surface 20A of latch 20 and surface 25 of latch 24. By locating the trip bar 67 away from the secondary latch pivot 66 such that the separation distance $X_4$, is large relative to $X_3$, a further reduction in trip force $P_2$ applied to $p_2$ is achieved. The mathematical relation between the trip force $P_2$, and the $(X_2/X_1)$ and $(X_4/X_3)$ ratios is given by:

$$P_2 = P_1 \frac{\mu}{\frac{X_2}{X_1} \cdot \frac{X_4}{X_3}}$$

where $\omega$ is the coefficient of friction. The effects of varying the distance ratios on the calibration yield were measured in a manner described earlier for breaker calibration wherein the breaker is subjected to 200% of rated current and the number of breakers successfully tripping within the required time interval is recorded. With a fixed operating spring and latch spring force and for a fixed coefficient of friction $\omega$, the trip force $P_2$ is found to exponentially depend on the ratio of separation distance $X_2$ to separation distance $X_1$ and the ratio of separation distance $X_4$ to separation distance $X_3$. Design contraints fix the ratio of separation distances $X_4$ and $X_3$, making the trip force $P_2$ dependent exclusively on the ratio of the separation distances $X_2$ and $X_1$. The relationship between the primary to secondary latch distance ratio $X_2/X_1$ and the trip force $P_2$ is shown at 79 in FIG. 5.

Point A on trip force curve 79 indicates the discontinuity that occurs when $X_1$ approaches zero, i.e. the centerline through the primary latch pivot 68 is directly under the point of contact $p_1$ such that the torque about pivot pin 68 becomes 0 and the primary latch is therefore unable to pivot and the breaker never trips. For ratios of $X_2/X_1$ greater than 10, theretherefore there is a tendency for the cradle to stall. A discontinuity at B occurs when the separation distance $X_1$ becomes large producing a proportionally large torque about pivot 68 which results in a trip force $P_2$ at $p_2$ that exceeds the available output force of the trip unit 11 such that the breaker is unable to trip. For ratios of $X_2/X_1$ less than 2 therefore, there is a tendency for the trip unit to stall.

A preferred operating ratio of the primary to secondary latch distances is between 2 and 10 with an optimum at 6. The ratio between these two distances therefore provides the necessary balance between what is easily achievable in production and an adequate trip unit efficiency that will result in high breaker yields at final calibration.

Although the circuit breaker assembly of the instant invention is described for use with E-Frame breakers, this is by way of example only. The features described and claimed herein find application in all type breaker designs which employ an operating mechanism to separate the breaker contacts under the control of a trip unit.

Having thus described our invention, what we claim as new and desire to secure by Letters Patent is:

1. A method for providing a circuit breaker assembly comprising the steps of:

arranging a contact spring and a lower link on a movable contact arm containing a movable contact to form a contact arm sub-assembly;

arranging an upper link, cradle and latch unit within a side frame to form an operating mechanism subassembly;

arranging a handle support yoke over said operating mechanism subassembly; and connecting an operating spring between said lower link and said handle support yoke for connecting said operating mechanism subassembly to said contact arm subassembly.

2. The method of claim 1 including the steps of:

arranging a primary latch on a first pivot connecting between a pair of side frames;

arranging a secondary latch on a second pivot proximate said primary latch on said side frame to form said latch unit.

3. The method of claim 1 including the step of arranging said first pivot within a slot in said primary latch for allowing said primary latch to translate between a first and second position.

4. The method of claim 1 including the steps of:

forming said primary latch from a die rolled planar metal surface;

forming said secondary latch from a die rolled planar metal surface; and orienting said primary and secondary latches so that the die rolled surfaces on both said latches abuttingly face each other.

5. The method of claim 1 including the step of biasing said primary latch is biased away from a trip mechanism trip bar by means of a latch spring.

6. The method of claim 1 wherein said operating spring is assembled by inserting an end of said operating spring along the outside of said support yoke within a hole in said support yoke.

7. The method of claim 6 wherein said operating spring is assembled in an unstressed condition.

8. The method of claim 1 wherein said contact spring is assembled by inserting an end of said contact spring within a slot in said contact arm.

9. The method of claim 8 wherein said contact spring is assembled in an unstressed condition.

* * * * *